US007546063B2

(12) United States Patent
Nishimura et al.

(10) Patent No.: US 7,546,063 B2
(45) Date of Patent: Jun. 9, 2009

(54) IMAGE CARRYING MEMBER CARTRIDGE AND IMAGE FORMING APPARATUS

(75) Inventors: Soichiro Nishimura, Aichi-ken (JP); Yoshinori Ito, Aichi-ken (JP)

(73) Assignee: Brother Kogyo Kabushiki Kaisha (JP)

( * ) Notice: Subject to any disclaimer, the term of this patent is extended or adjusted under 35 U.S.C. 154(b) by 365 days.

(21) Appl. No.: 11/313,688

(22) Filed: Dec. 22, 2005

(65) Prior Publication Data

US 2006/0140671 A1 Jun. 29, 2006

(30) Foreign Application Priority Data

Dec. 27, 2004 (JP) ..... 2004-378087

(51) Int. Cl.
*G03G 21/16* (2006.01)
*G03G 15/08* (2006.01)
*G03G 15/20* (2006.01)
*G03G 21/00* (2006.01)

(52) U.S. Cl. ..... 399/111; 399/121; 399/123; 399/353

(58) Field of Classification Search ..... 399/92, 399/98, 111, 121, 123, 343, 353, 357
See application file for complete search history.

(56) References Cited

U.S. PATENT DOCUMENTS 4,278,342 A * 7/1981 Andrew et al. ..... 399/353 X
5,371,575 A * 12/1994 Sekino et al. ..... 399/121 X
5,606,406 A * 2/1997 Ikeyama et al. ..... 399/111
5,848,326 A * 12/1998 Komuro et al. ..... 399/98
5,923,935 A * 7/1999 Yamaguchi ..... 399/121 X
6,101,350 A 8/2000 Suzuki et al.
6,522,847 B2 2/2003 Nanjo
6,836,639 B2 * 12/2004 Karakama et al. ..... 399/123 X
6,922,537 B2 * 7/2005 Iikawa et al. ..... 399/92
7,181,156 B2 * 2/2007 Kabata et al. ..... 399/123 X

FOREIGN PATENT DOCUMENTS

| | | |
|---|---|---|
| JP | 4128775 | 4/1992 |
| JP | 5216321 | 8/1993 |
| JP | 5224518 | 9/1993 |
| JP | 2001282063 | 10/2001 |
| JP | 2002023580 | 1/2002 |
| JP | 2003241607 | 8/2003 |

* cited by examiner

*Primary Examiner*—Sandra L Brase
(74) *Attorney, Agent, or Firm*—Banner & Witcoff, Ltd.

(57) ABSTRACT

An image carrying member cartridge includes an image carrying member; a charging device disposed along an axial direction of the image carrying member for charging the image carrying member; a cleaning member disposed below the charging device and along the axial direction of the image carrying member and provided to remove adherents from the image carrying member; and a cartridge housing that accommodates the image carrying member, the charging device and the cleaning member. The cartridge housing includes a sheet outlet below the cleaning member for discharging a recording medium. Ends of the cleaning member in the axial direction of the image carrying member are located closer to a center of the image carrying member in the axial direction as compared with ends of an opening of the sheet outlet in the axial direction.

26 Claims, 9 Drawing Sheets

IMAGE CARRYING MEMBER CARTRIDGE AND IMAGE FORMING APPARATUS

CROSS REFERENCE TO RELATED APPLICATION

This application claims priority from Japanese Patent Application No. 2004-378087, filed in Japan on Dec. 27, 2004. This priority application is entirely incorporated herein by reference.

TECHNICAL FIELD

The invention relates to image carrying member cartridges and image forming apparatuses that form images by developing electrostatic latent images formed on image carrying members.

BACKGROUND

There have been known image forming apparatuses that perform image formation by developing electrostatic latent images formed on a photosensitive drum.

Such image forming apparatuses may include a detachable process unit in order to facilitate replenishment of toner. The process unit may include a developing cartridge and a drum cartridge. The developing cartridge accommodates a toner tank for holding toner and a mechanism for developing an image using toner. The drum cartridge accommodates a photosensitive drum (functioning as an image carrying member) and mechanisms provided around the photosensitive drum. The developing cartridge is designed to be attachable and detachable with respect to the drum cartridge.

For example, as shown in FIG. 8, a drum cartridge commonly includes a photosensitive drum 101; a charging device 102 that uniformly charges a surface of the photosensitive drum 101; a transfer roller 103 that is used to transfer, onto a sheet P, a visible image (a toner image) that is obtained by development of an electrostatic latent image formed on the photosensitive drum 101 by using toner; and a cleaner 104 that removes foreign matter (e.g., paper dust) adhering to the photosensitive drum 101 after image transfer. A housing of the drum cartridge is partially indicated in FIG. 8 by a dot and dashed line. The housing of the drum cartridge covers various portions and members except a sheet inlet 105 is provided through which a sheet P is taken into the drum cartridge, a sheet outlet 106 is provided through which the sheet P is ejected from the drum cartridge, a back of the charging device 102 may form a portion of the housing, and a laser path 107 is provided through which laser light emitted from a scanner unit passes.

A discharge-type charging device, such as a scorotron charger, generally is used as the charging device 102 to perform non-contact charging on the photosensitive drum 101. The charging device 102 is commonly disposed above the photosensitive drum 101. In this case, the cleaner 104 needs to be disposed at an upstream position from the charging device 102 with respect to a rotating direction of the photosensitive drum 101 (a clockwise direction in FIG. 8), and the charging device 102 is arranged next to the photosensitive drum 101 in a horizontal direction in conjunction with an arrangement of the other elements.

When a member, for example, a brush, used as the cleaner 104, contacts the photosensitive drum 101, the flow of air around the photosensitive drum 101 is obstructed by the cleaner 104 and an inner wall of the housing of the drum cartridge. As a result, moisture in the air and ozone generated by the charging device 102 are likely to build up at an upper portion of the cleaner 104 in the drum cartridge.

If the photosensitive drum 101 is not rotated while moisture and ozone build up inside the drum cartridge, a film developed on the surface of the photosensitive drum 101 (e.g., a buildup of foreign matter on the surface of the photosensitive drum 101) may excessively take up or include the moisture and ozone, such that it may be difficult to expose the surface of the photosensitive drum 101 with laser light. If printing is performed after the photosensitive drum 101 is left in such a condition, the photosensitive drum 101 may not be able to carry enough toner at the moistened portion on the filming, so that an undesired white stripe (a band of a print dropout that extends in a sheet width direction perpendicular to a sheet conveying direction) may appear on a printed result.

In order to resolve the above problem, for example, Japanese Laid-Open Patent Publication No. 5-216321 discloses a device that includes a duct having a fan and a pipe provided between a charging device and a cleaner in order to forcefully exhaust ozone generated by the charging device. The inclusion of this new duct element, however, undesirably increases the size of the image forming apparatus.

SUMMARY

One aspect of this invention relates to image carrying member cartridges, e.g., of the type that may be detachably attachable to an image forming apparatus. Image carrying member cartridges according to at least some examples of this invention may include an image carrying member (e.g., one that is capable of rotating and carries on its periphery a visible image produced by development of an electrostatic latent image using a developing agent); a charging device disposed along an axial direction of the image carrying member; a cleaning member disposed below the charging device and along the axial direction of the image carrying member, wherein the cleaning member may be arranged to remove adherents from the image carrying member (e.g., by contacting the image carrying member with a brush, etc.); and a cartridge housing that accommodates the image carrying member, the charging device and the cleaning member. The cartridge housing further may include a sheet outlet below the cleaning member to discharge therefrom a recording medium (e.g., such as paper, a transparency, metal, other sheet-like materials, or the like, optionally onto which a visible image carried on the image carrying member has been transferred). The cleaning member's dimension in the axial direction of the image carrying member may be less than a dimension of an opening of the sheet outlet in the axial direction of the image carrying member. In at least some examples of cartridges in accordance with the invention, ends of the cleaning member in the axial direction of the image carrying member may be located at positions closer to a center or middle portion of the image carrying member in the axial direction as compared with ends of the opening of the sheet outlet in the axial direction of the image carrying member.

Still additional example aspects of the invention relate to image forming apparatuses that may include: an image carrying member (e.g., one that is capable of rotating and carries on its periphery a visible image produced by development of an electrostatic latent image using a developing agent); a charging device disposed along an axial direction of the image carrying member for charging the image carrying member; a cleaning member disposed below the charging device and along the axial direction of the image carrying member, wherein the cleaning member is arranged to remove adherents from the image carrying member (e.g., by contacting the image carrying member with a brush); and a support member that accommodates the image carrying member, the charging device and the cleaning member. The support member in at least some structures according to the invention may include a sheet outlet below the cleaning member to discharge therefrom a recording medium (e.g., onto which a visible image carried on the image carrying member has been transferred). The cleaning member's dimension in the axial direction of the image carrying member may be less than a dimension of an opening of the sheet outlet in the axial direction of the image carrying member. In at least some examples, ends of the cleaning member in the axial direction of the image carrying member may be located closer to a center or middle portion of the image carrying member in the axial direction thereof as compared with ends of an opening of the sheet outlet in the axial direction of the image carrying member.

Structures in accordance with at least some example aspects of this invention may provide image carrying member cartridges and/or image forming apparatuses having compact structures, wherein undesired buildup of moisture, ozone, and/or other debris is reduced and/or prevented.

BRIEF DESCRIPTION OF THE DRAWINGS

Illustrative aspects and example structures according to the invention will be described in detail with reference to the following figures, wherein.

DETAILED DESCRIPTION

Figure 1:
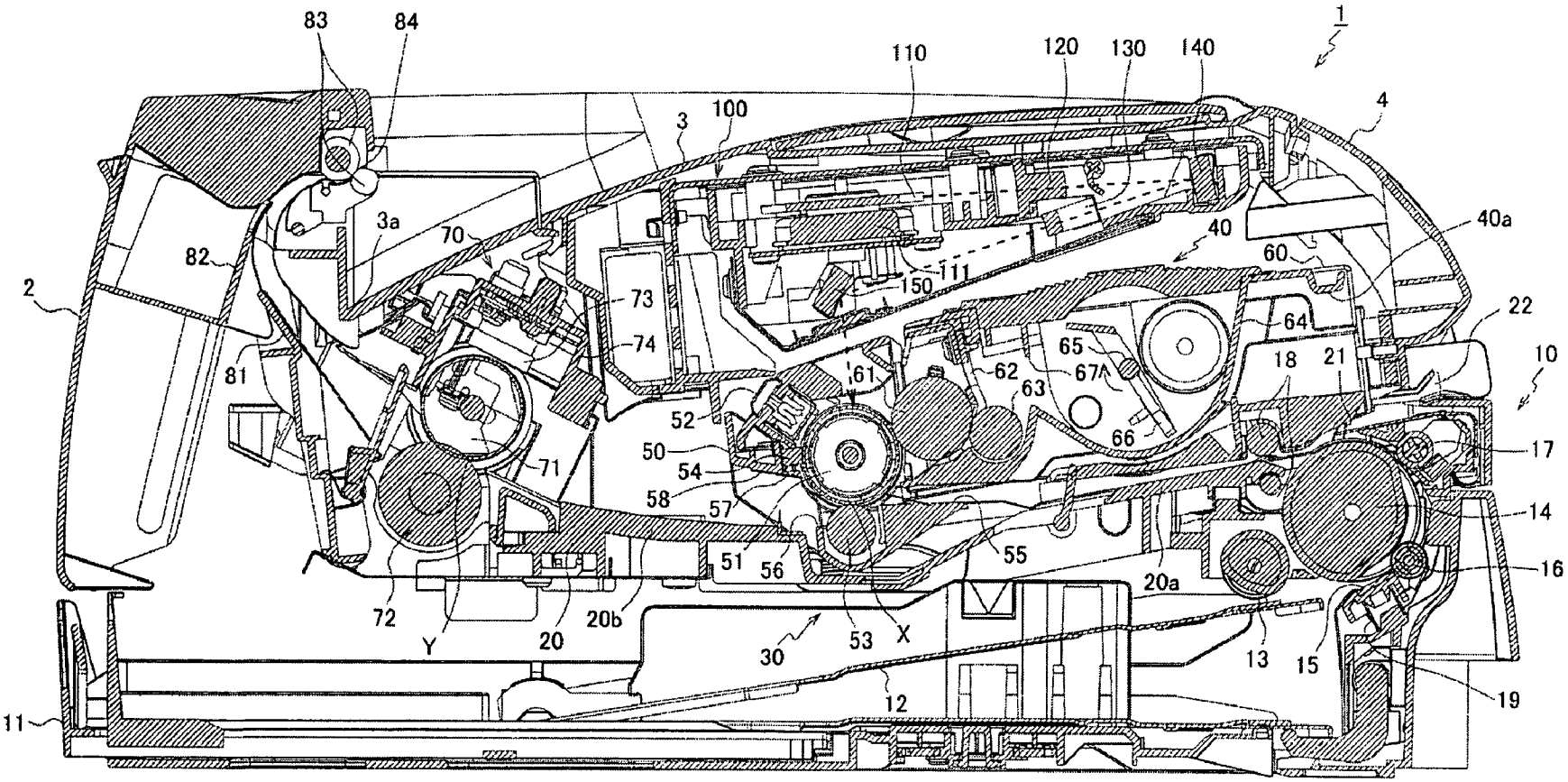
FIG. 1 is a sectional view showing various parts of one example printer structure according to the invention.

I. General Description of Structures According to at Least Some Examples of the Invention In the description that follows, various connections are set forth between elements in an overall structure. The reader should understand that these connections in general and, unless specified otherwise, may be direct or indirect and that this specification is not intended to be limiting in this respect.

Aspects of this invention relate to image carrying member cartridges and image forming apparatuses that may include such cartridges. Image carrying member cartridges according to at least some examples of this invention may include: (a) an image carrying member; (b) a charging device disposed along an axial direction of the image carrying member for charging the image carrying member; (c) a cleaning member disposed below the charging device and along the axial direction of the image carrying member, wherein the cleaning member is arranged to remove adherents from the image carrying member; and (d) a cartridge housing that accommodates the image carrying member, the charging device and the cleaning member. The cartridge housing may include a sheet outlet below the cleaning member to discharge therefrom a recording medium. The cleaning member dimension in the axial direction of the image carrying member may be less than a dimension of an opening of the sheet outlet in the axial direction of the image carrying member. In at least some examples of cartridges in accordance with the invention, the ends of the cleaning member in the axial direction of the image carrying member may be located closer to a center of the image carrying member in the axial direction thereof as compared with the ends of an opening of the sheet outlet in the axial direction of the image carrying member. If desired, the cleaning member may be substantially centered within the sheet outlet, with respect to the axial direction (e.g., so as to allow open areas or paths along each side of the cleaning member).

Following the example dimensional aspects described above, the cleaning member in accordance with at least some examples of this invention may be disposed so as to partially obstruct the space extending from the charging device to the sheet outlet along the surface of the image carrying member, but it does not completely obstruct the space. Therefore, a gas exhaustion path (e.g., for air, water vapor, ozone, etc.) may remain, for example, between one or more of the ends of the sheet outlet opening and the cleaning member end(s) so that gas can be exhausted downwardly along one or more sides of the cleaning member (e.g., ozone, which is heavier than air, can be effectively removed through the gas exhaustion path; moisture or other debris also can be effectively removed, for example, by gas flow caused by ozone removal or other air or gas movement, by an exhaust fan, etc.; etc.). In this manner, without providing a new element (such as a duct, etc.), moisture, ozone, paper dust, and other debris, which may cause "banding" (e.g., an undesired white stripe or print dropout in a printed product) can be reduced or prevented (e.g., by reducing or preventing undesired film formation on the image carrying member surface due to the undesired presence of ozone, moisture, debris, etc.).

Still additional aspects of the invention relate to image forming devices that include image carrying member cartridges attached thereto, e.g., image carrying member cartridges of the types described above.

If desired, the image carrying member cartridges further may include a developing device or system (e.g., including one or more of a developer storage container or hopper, an agitator device, a developing roller, a developer thickness regulating blade, a developer inlet, and/or other elements). The developing device or system may be integrally formed as part of the image carrying member cartridge or as a separate element attached thereto (e.g, in a detachable manner) without departing from this invention. Alternatively, if desired, a developing device or system may be separately included with or attached to the image forming apparatus, e.g., as one or more elements separate from the image carrying member cartridge.

Any type of recording medium may be used in conjunction with image carrying member cartridges and/or image forming apparatuses without departing from the invention, such as paper (e.g., of various sizes, weights, qualities, etc.), transparencies, plastics, polymers, metal, or other sheet materials or substrates. Also, the cleaning member may remove any types of adherents or foreign matter from the image carrying member without departing from the invention, such as excess toner or developer, paper dust, metal particles, other debris, etc. If desired, the adherents removed from the image carrying member may be disposed in a receiving member, e.g., integrally formed as part of the cartridge, attached to the cartridge, attached to the image forming apparatus, formed as an integral part of the image forming apparatus, etc. Optionally, the receiving member may be disposed below the cleaning member, for example, to receive the adherents removed by the cleaning member under force of gravity and/or air flow (e.g., induced by an exhaust fan, etc.). In at least some examples of this invention, the receiving member will be provided as close as possible to the image carrying member so as not to spill or miss adherents removed from the image carrying member. In order to reduce obstruction of gas flow due to the presence of the receiving member, if desired, in accordance with at least some example structures according to the invention, the ends of the receiving member in the axial direction of the image carrying member may be located at positions substantially the same as or optionally just outside of the ends of the cleaning member. Additionally or alternatively, the ends of the receiving member may be located somewhat closer to the end portions of the image carrying member in the axial direction as compared to the ends of the cleaning member. In this manner, in light of this structure, the receiving member can reliably receive the adherents and/or debris without adversely or excessively impacting gas exhaust flow.

In at least some examples of this invention, the cleaning member will be sized and positioned so as to span at least a maximum printable area dimension on the recording medium in the axial direction (e.g., because developing agent typically is present predominantly within the printable area on the image carrying member, at least some examples of this invention will provide the cleaning member along any areas of the image carrying member that typically may be exposed to developing agent, i.e., the "printable area"). Optionally or alternatively, if desired, the cleaning member will span at least a maximum recording medium dimension in the axial direction (e.g., because paper dust tends to come out from end portions of a sheet in its width direction, at least some examples of this invention will provide the cleaning member along any areas of the image carrying member that make contact with the sheet (as these areas typically may collect dust)). In still other examples of this invention, the cleaning member will be sized and positioned so as to span at least a minimum recording medium dimension in the axial direction (e.g., in this example structure, the overall width of the cleaning member in the axial direction can be reduced, so that a wide gas exhaustion path can be provided to allow high moisture and ozone removal while still removing much of any residual toner and/or other debris from the image carrying member).

Image forming apparatuses in accordance with at least some examples of this invention further may include one or more conveyor rollers, provided in (and/or at least partially defining) a recording medium conveying path, e.g., that extends from a recording medium accommodating portion to the image carrying member. Defining any portion of the recording medium that contacts the conveyor roller as a "target portion," cleaning members in accordance with at least some examples of this invention may be sized and positioned so as to clean at least the portion(s) of the image carrying member that contact the "target portion(s)" of the recording medium during image transfer. This structure can be advantageous, for example, for cleaning paper dust. Paper dust tends to remain on paper at a location where the paper contacts a conveying roller. This paper dust can be transferred to the image carrying member when the paper contacts the image carrying member during image transfer. Therefore, providing a cleaning member for the image carrying member at least at locations along the axial direction of the image carrying member corresponding to conveyor roller contact with the paper, can help effectively remove paper dust adhering to the image carrying member. In addition, limiting the cleaning device width and/or locations to locations of the image carrying member corresponding to the roller contact locations can provide a smaller cleaning member in at least some examples of this invention, which can be used to provide more and/or wider gas exhaustion paths for removal of moisture, ozone, debris, etc. If desired, the cleaning member may constitute a single device (e.g., a single brush), multiple devices (e.g., multiple brushes or brush regions) independently mounted or mounted via a common base member, etc. A wide variety of cleaning member structures may be provided without departing from this invention.

Cartridge housings included in image carrying member cartridges according to at least some examples of this invention further may include first and second guide walls that extend in the axial direction along or adjacent a surface of the image carrying member. These guide walls may be located along or adjacent the charging device, upstream and downstream, respectively, with respect to a rotating direction of the image carrying member. The guide walls may be separated from the surface of the image carrying members by various clearance distances without departing from the invention. In at least some examples of this invention, the clearance distance associated with the upstream guide wall may be greater than the clearance distance associated with the downstream guide wall. Guide walls having this arrangement can help lead ozone generated by the charging device away from the image carrying member surface and out of the cartridge housing, which can also improve performance during the charging operation.

Given the above general description of various examples and aspects of the invention, a more detailed description of various specific examples of image carrying member cartridges and/or image forming apparatuses according to examples of this invention will be provided below.

II. Detailed Description of Example Structures According to the Invention

As shown in FIG. 1, a laser printer 1 according to this illustrated example includes, in a main casing 2, a feeder portion 10 that feeds a sheet, such as paper, as a recording medium, and an image forming portion 30 that forms an image on a sheet fed therein. At a top of the main casing 2, an output tray 3 is provided for receiving a sheet having an image printed thereon by the laser printer 1. In the following description, the right in FIG. 1 will be referred to as the front side of the laser printer 1, the left in FIG. 1 will be referred to as the back or rear of the laser printer 1, and the far side and the near side in FIG. 1 will be referred to as the right and the left of the laser printer 1, respectively.

The feeder portion 10 of this example printer structure 1 includes a sheet supply tray 11, a sheet pressing plate 12 provided in the sheet supply tray 11, a pickup roller 13, a sheet supply roller 14 (functioning as a conveyor roller), a separating pad 15, a pinch roller 16, a paper dust removing roller 17 and a pair of register rollers 18. The pickup roller 13 is provided at an upper portion of a front end portion of the sheet supply tray 11. The pinch roller 16 is disposed facing the sheet supply roller 14. The register rollers 18 are disposed downstream from the paper dust removing roller 17 in a sheet conveying direction.

The sheet supply tray 11 in this example structure may include sheets loaded in layers therein and may be removably attachable to the bottom portion of the main casing 2. The sheet supply tray 11 may be drawn toward the front of the laser printer 1, for example, when a user replenishes the sheet supply tray 11 with sheets. When the sheet supply tray 11 is drawn toward the front, the feeder portion 10 is separated from the housing 2 at a position between the sheet supply roller 14 and the separating pad 15. Thus, in this example sheet supply tray structure 11, the pinch roller 16, the separating pad 15 and a spring 19 that is disposed under the separating pad 15 are drawn toward the front together with the sheet supply tray 11. Of course, other arrangements of the various parts are possible without departing from the invention.

The sheet pressing plate 12 is pivotably supported at its rear end (a far end from the sheet supply roller 14) while its front end (an end opposite to the far end) is upwardly urged by a spring (not shown) and is rotatable up and down. With this structure, the sheet pressing plate 12 rotates downward against an urging force of the spring about its rear end as the weight or number of sheets in the tray 11 increases.

The pickup roller 13 in this example printer structure 1 contacts a topmost sheet of the stack of sheets loaded in the sheet supply tray 11 and conveys the topmost sheet to a position where the sheet supply roller 14 can further convey the sheet (e.g., to a position between the sheet supply roller 14 and the separating pad 15).

The separating pad 15 is disposed facing the sheet supply roller 14 and is pressed toward the sheet supply roller 14 by a spring 19 provided at an underside of the separating pad 15. The separating pad 15 has a function of preventing multiple sheets from being supplied simultaneously to a sheet conveying path. That is, an appropriate frictional force is applied to a portion between the separating pad 15 and the sheets. Therefore, if multiple sheets are supplied to the separating pad 15 by the pickup roller 13, the sheets other than the topmost sheet are caught by the separating pad 15. As a result, sheets are supplied one-by-one by the sheet supply roller 14.

The separated sheet is then supplied to a sheet conveying path by the sheet supply roller 14. More specifically, in this example printer structure 1, the sheet is forwarded to the register rollers 18 after paper dust adhering to the sheet is removed by the paper dust removing roller 17. In the sheet conveying path, a section between the upper end of the sheet supply roller 14 and an image forming position X (which is a contact position between a photosensitive drum 51 and a transfer roller 53) is defined so as to extend on a downward incline with respect to a horizontal direction, and a section downstream from the image forming position X is defined so as to extend on an upward incline with respect to the horizontal direction. Of course, other sheet conveying path arrangements are possible without departing from the invention.

In the sheet conveying path, most of the section between the sheet supply roller 14 and the image forming position X is defined by a guide member 20*a* and a bottom surface of a process unit 40. The guide member 20*a* of this example is integrally formed with a housing frame 20 made of resin. The housing frame 20 is provided in a body of the laser printer 1 and is a part of the main casing 2. Most of the section of the sheet conveying path between the image forming position X and an image fixing position Y (which is a contact position between a fixing roller 71 and a pressure roller 72) is defined by a guide member 20*b*.

The sheet supply roller 14 supplies the sheet to the register rollers 18 with the sheet upside down (i.e., after turning the sheet approximately 180 degrees). Because the sheet is conveyed as described above, if a curvature of the sheet supply roller 14 is large and a thick sheet, for example, a postcard, is supplied, the thick sheet may be folded at the sheet supply roller 14 or may not be appropriately supplied to the register rollers 18 due to resistance caused when the thick sheet is folded at the sheet supply roller 14. In order to prevent or avoid such a problem, the sheet supply roller 14 may have a diameter that is relatively larger than that of the photosensitive drum 51 and/or the fixing roller 71 (for example, the diameter of the photosensitive drum 51 may be 24 mm, the diameter of the fixing roller 71 may be 25 mm, and the diameter of the sheet supply roller 14 may be 33 mm). As described above, the diameter of the sheet supply roller 14 may be designed to be relatively large to make the curvature of a warp of the sheet small. Thus, sheets typically can be conveyed in a good condition without being folded by the sheet supply roller 14.

Operation (the driving and stopping) of the register rollers 18 may be controlled by a controller that is provided on a substrate (not shown) disposed in the main casing 2, e.g., in accordance with a detection timing of a position sensor 21 that is provided upstream from the register rollers 18 in the sheet conveying direction. By the control of the register rollers 18 by the controller, skewing of the sheet may be corrected or reduced. That is, while the sheet is conveyed by the sheet supply roller 14, the controller allows the register rollers 18 to be in a driving state. When the position sensor 21 detects a leading edge of the sheet, the controller allows the register rollers 18 to stop. Then, when the sheet contacts the register rollers 18 and warps, the controller allows the register rollers 18 to drive again to convey the sheet to the image forming portion 30. In this example laser printer 1, the position sensor 21 is a mechanical device, and the position of the position sensor 21 is changed when pressed by the sheet. Of course, other types of sensors, such as optical sensors or contact sensors, may be used without departing from this invention.

A manual sheet feed port 22 is provided in this example printer structure 1 above the sheet supply roller 14 in order to directly feed a sheet to the register rollers 18 from the front of the laser printer 1. Through the manual sheet feed port 22, sheets can be fed to the sheet conveying path without being loaded in the sheet supply tray 11.

The image forming portion 30 in this example printer structure 1 includes a scanner unit 100, the process unit 40, and a fixing unit 70. These units are described in more detail below.

The scanner unit 100 in this example structure 1 is provided at an upper portion in the main casing 2. This example scanner unit 100 includes a laser light source (not shown), a rotatable polygon mirror 110 driven by a polygon motor 111, an fθ lens 120, a cylindrical lens 130, and reflecting mirrors 140, 150. In the scanner unit 100, as shown in a chain line in FIG. 1, a laser beam emitted from the laser light source, based on image data, is deflected by the polygon mirror 110, passes through the fθ lens 120, is turned by the reflecting mirror 140, passes through the cylindrical lens 130, and is turned downward by the reflecting mirror 150. In this manner, the laser beam is irradiated onto a surface of the photosensitive drum 51 of the process unit 40 at high-speed scanning.

In the scanner unit 100, the polygon mirror 110 is disposed above the photosensitive drum 51. A laser beam reflected by the polygon mirror 110 travels in a substantially horizontal direction toward the reflecting mirror 140, is reflected by the reflecting mirror 140, and further travels toward the reflecting mirror 150 disposed under the polygon mirror 110. That is, the reflecting mirror 140 acutely downwardly reflects the laser beam incident thereto.

The process unit 40 of this example printer structure 1 is disposed below the scanner unit 100 at a distance therefrom and is detachably attachable to the main casing 2 in the substantially horizontal direction from the front of the laser printer 1. This example process unit 40 includes a drum cartridge 50 (functioning as an image carrying member cartridge) and a developing cartridge 60.

Figure 2A:
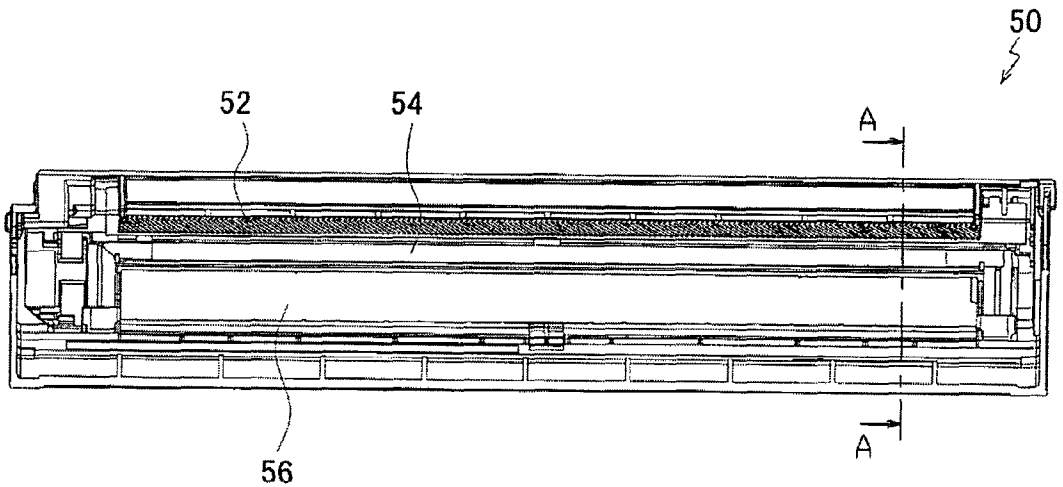
FIG. 2A is a front view of an example drum cartridge structure according to at least some examples of this invention.
Figure 2B:
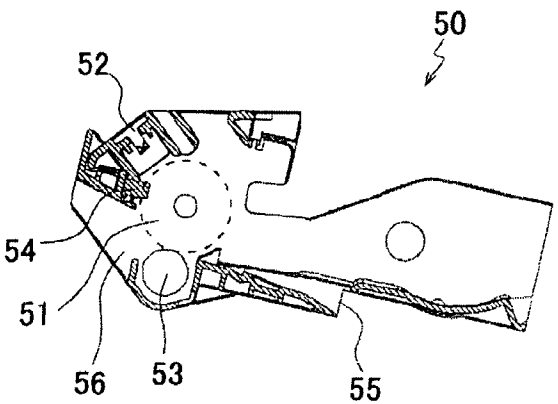
FIG. 2B is a sectional view of the drum cartridge structure taken along line A-A of FIG. 2A.

The drum cartridge 50 of this example includes the photosensitive drum 51, a charging device 52, the transfer roller 53, and a cleaning brush 54 (functioning as a cleaning member) therein. FIG. 2A is a front view of this example drum cartridge 50 when viewed from the front of the laser printer 1. FIG. 2B is a sectional view of the drum cartridge 50 taken along line A-A of FIG. 2A. In FIGS. 2A and 2B, the photosensitive drum 51 is not mounted on the drum cartridge 50.

The developing cartridge 60 of this example printer structure 1 includes a developing roller 61, a layer-thickness regulating blade 62, a toner supply roller 63, and a toner box 64. The developing cartridge 60 is detachably attachable to the drum cartridge 50, although, if desired, the drum cartridge 50 and the developing cartridge 60 may be integrally formed as a unitary structure without departing from this invention.

In the toner box 64, an agitator 66 is provided to agitate the toner stored in the toner box 64. The agitator 66 is supported by a rotating shaft 65 that is provided at a center of the toner box 64. By rotating the agitator 66 about the rotating shaft 65 in a direction indicated by an arrow in FIG. 1 (e.g., a counterclockwise direction), the toner reserved in the toner box 64 is agitated by the agitator 66 and is discharged from a toner supply port 67 provided in the toner box 64.

The toner supply roller 63 is disposed at the side of the toner supply port 67 so as to be rotatable in the counterclockwise direction in the example structure of FIG. 1. The developing roller 61 is disposed facing the toner supply roller 63 so as to be rotatable in the same direction (the counterclockwise direction in FIG. 1) as the rotating direction of the toner supply roller 63. The toner supply roller 63 and the developing roller 61 are in contact with each other so that they are press-deformed against each other to an appropriate extent.

The toner supply roller 63 of this example includes a metallic roller shaft covered with a roller portion made of a conductive foam material. The developing roller 61 of this example includes a metallic roller shaft covered with a roller portion made of a conductive rubber material that does not have a magnetic property. More specifically, the roller portion of the developing roller 61 in this example structure is made of conductive urethane rubber or conductive silicone rubber containing carbon particles, and its surface is covered with a coating layer made of urethane rubber or silicone rubber containing fluorine. A developing bias may be applied to the developing roller 61.

The layer-thickness regulating blade 62 is disposed near the developing roller 61. The layer-thickness regulating blade 62 includes a blade body made of, for example, a metal leaf spring, and a pressing portion made of, for example, insulative silicone rubber. The pressing portion may be formed in a semicircular shape in a sectional view and may be provided at a free end (a tip) of the blade body. A base end of the blade body (i.e., the end opposite to the end provided with the pressing portion) may be supported by the developing cartridge 60 at a position near the developing roller 61 such that the pressing portion can contact the surface of the developing roller 61. The pressing portion of the blade body of the layer-thickness regulating blade 62 press-contacts the developing roller 61 by an elastic force of the blade body. Of course, any desired layer-thickness regulating system and arrangement may be used without departing from this invention.

The toner discharged from the toner supply port 67 is supplied to the developing roller 61 by rotation of the toner supply roller 63. At that time, the toner is positively charged by the friction caused between the toner supply roller 63 and the developing roller 61. The toner supplied onto the developing roller 61 then goes between the pressing portion of the layer-thickness regulating blade 62 and the developing roller 61 by the rotation of the developing roller 61. The toner is sufficiently charged by the friction caused between the pressing portion of the layer-thickness regulating blade 62 and the developing roller 61, and the toner becomes a thin layer, of uniform thickness, that is carried on the surface of the developing roller 61.

The photosensitive drum 51 in this example printer structure 1 is disposed at the side of the developing roller 61. The photosensitive drum 51 is rotatable in a direction reverse to the rotating direction of the developing roller 61 (i.e., in a clockwise direction in FIG. 1) while facing the developing roller 61. The photosensitive drum 51 includes a drum body that is connected to a ground. An outer layer of the photosensitive drum 51 is a positively-charged photosensitive layer made of, for example, polycarbonate. Any desired photoconductor structure and/or materials may be used without departing from this invention. The photosensitive drum 51 is driven by power inputted by a main motor (not shown).

The charging device 52 in this example printer structure 1 may be a scorotron charger that generates a corona discharge from a charging wire, such as a tungsten wire, to positively uniformly charge the surface of the photosensitive drum 51 in accordance with the rotation of the photosensitive drum 51. The charging device 52 is disposed facing the photosensitive drum 51 at a specified distance so as not to contact the photosensitive drum 51. The charging device 52 is located at a diagonally-upper-rear position with respect to the photosensitive drum 51 (at an angle approximately 30 degrees upward from the horizontal, as shown in FIG. 1).

Figure 3:
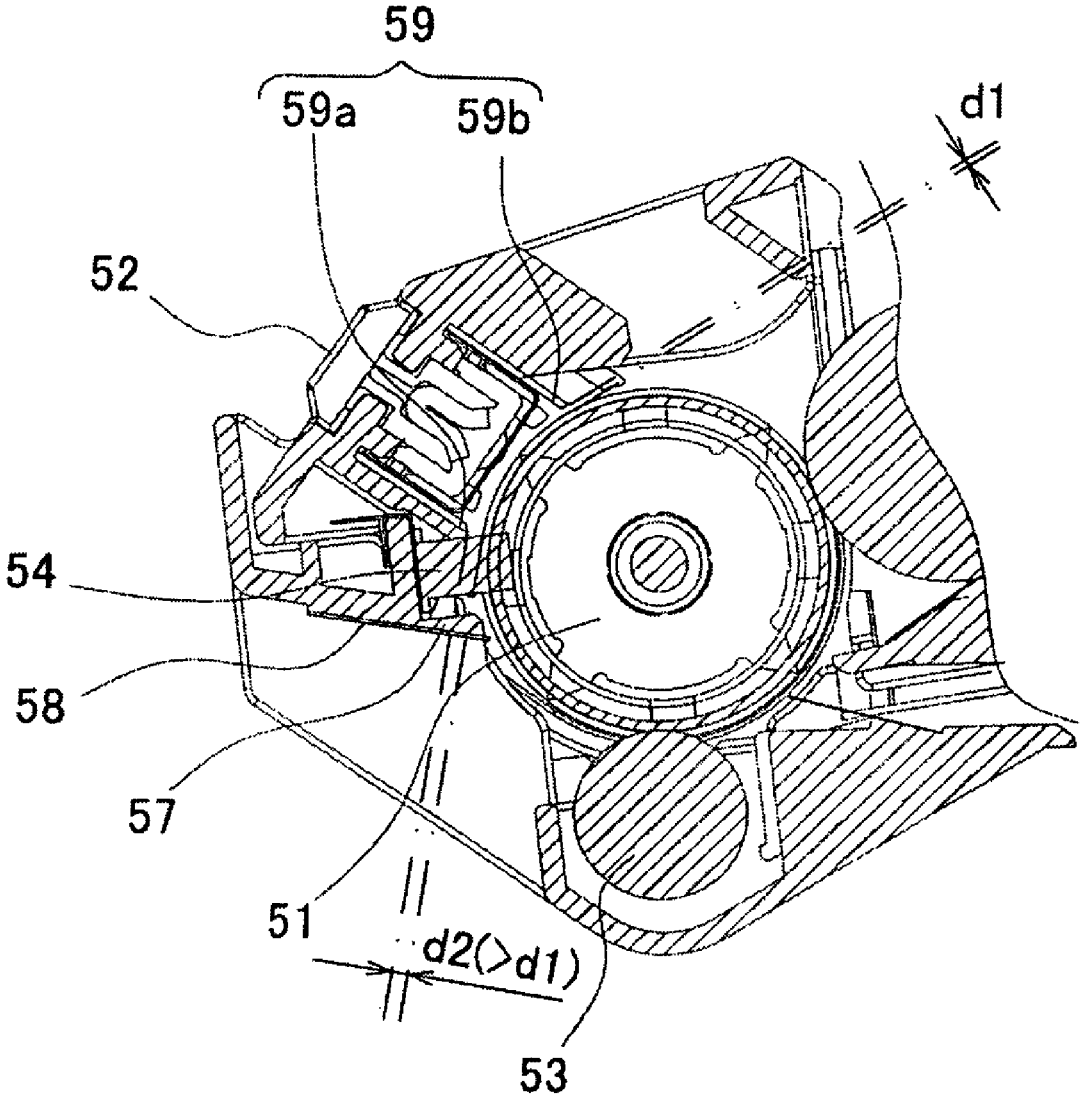
FIG. 3 is an enlarged view of an example photosensitive drum and its surroundings according to at least some examples of this invention.

As shown in FIG. 3, a pair of guide walls 59, including a first guide wall portion 59*a* and a second guide wall portion 59*b*, is provided on opposite sides of the charging device 52 with respect to a rotating direction of the photosensitive drum 51. With this structure, the photosensitive drum 51 is efficiently charged by the charging device 52. The first guide wall portion 59*a* of the pair of guide walls 59 is disposed on an upstream side with respect to the rotating direction of the photosensitive drum 51, that is, near the cleaning brush 54. The pair of guide walls 59 may be designed and arranged such that a clearance distance d2 provided between a tip of the first guide wall portion 59*a* and the surface of the photosensitive drum 51 is larger than a clearance distance d1 provided between a tip of the second guide wall portion 59*b* and the surface of the photosensitive drum 51. Using this structure, ozone generated by operation of the charging device 52 can be effectively guided toward the clearance d2 and away from the photosensitive drum 51 and/or the interior of the cartridge 50 and the image forming portion 30.

After the surface of the photosensitive drum 51 is uniformly positively charged by the charging device 52, as discussed above, the surface of the photosensitive drum 51 is exposed to the laser beam emitted from the scanner unit 100 by the high-speed scanning process and an electrostatic latent image, based on predetermined image data, is formed on the surface of the photosensitive drum 51.

After that, by the rotation of the developing roller 61, when the positively-charged toner carried on the developing roller 61 faces and contacts the photosensitive drum 51, the toner is supplied and adheres to the electrostatic latent image formed on the surface of the photosensitive drum 51, that is, it adheres to the portion of the surface of the photosensitive drum 51 that was exposed by the laser beam and whose electric potential has been lowered. The toner is selectively carried by the photosensitive drum 51 when the toner adheres to the exposed portion(s) of the surface of the photosensitive drum 51, and the electrostatic latent image is visualized. Thus, a reversal phenomenon is accomplished.

The transfer roller 53 is disposed under the photosensitive drum 51 in this example printer structure 1 so as to be opposite thereto. The transfer roller 53 is supported in the drum cartridge 50 so as to be rotatable in a direction reverse to the rotating direction of the photosensitive drum 51 (i.e., in the counterclockwise direction in the example of FIG. 1). The transfer roller 53 of this example includes a metallic roller shaft covered with a roller portion made of a rubber material having ionic conductivity. A transfer bias (a forward bias) is applied to the transfer roller 53. With this structure, a visible image (a toner image) carried on the surface of the photosensitive drum 51 is transferred onto the sheet while the sheet passes (through the image forming portion X) between the photosensitive drum 51 and the transfer roller 53.

The housing of the drum cartridge 50 of this example structure has a sheet inlet 55 that is provided upstream (the right in FIG. 1) from the image forming position X and a sheet outlet 56 that is provided downstream (the left in FIG. 1) from the image forming position X, with respect to the sheet conveying direction. The sheet inlet 55 is provided to take a sheet into the inside of the housing of the drum cartridge 50, and the sheet outlet 56 is provided to eject a sheet to the outside of the housing of the drum cartridge 50.

The cleaning brush 54 in this example structure is disposed between the sheet outlet 56 and the charging device 52 (at the left of the photosensitive drum 51 in FIG. 1) and stays substantially horizontal to the photosensitive drum 51 while a tip of the cleaning brush 54 is in contact with the surface of the photosensitive drum 51. The cleaning brush 54 removes, from the photosensitive drum 51, foreign matter, such as paper dust, excess toner, etc., adhering to the photosensitive drum 51 (e.g., from the sheet) after the photosensitive drum 51 and the sheet contact each other during image formation at the image forming position X.

The sheet outlet 56 of this example structure is defined by an edge of an opening formed in the housing of the drum cartridge 50. An upper edge portion of the opening of the sheet outlet 56 horizontally extends toward the surface of the photosensitive drum 51. Both ends (in the axial direction of the photosensitive drum 51) of the upper edge portion of the sheet outlet 56 are cut away in this example structure so as to form a foreign matter receiving portion 57 that receives foreign matter removed from the surface of the photosensitive drum 51 by the cleaning brush 54. A lower cleaning film 58 may be adhered to an underside (an outer wall surface) of the foreign matter receiving portion 57, if desired, such that its free end extends toward the photosensitive drum 51 beyond the foreign matter receiving portion 57 so as to receive the removed foreign matter together with the foreign matter receiving portion 57.

In at least some example structures 1, the foreign matter receiving portion 57 will be disposed as close as possible to the photosensitive drum 51 in order to efficiently receive paper dust or other debris removed by the cleaning brush 54. However, it can be difficult to provide the foreign matter receiving portion 57 at a position close enough to the photosensitive drum 51 due to dimensional accuracy required when the housing of the drum cartridge 50 is manufactured. For this reason, the lower cleaning film 58 may be provided because the lower cleaning film 58 can be adhered to the foreign matter receiving portion 57 after the housing of the drum cartridge 50 is manufactured. The lower cleaning film 58 may have a length that is longer than that of the sheet supply roller 14. A portion of a sheet to be contacted with the sheet supply roller 14 is referred to as a sheet "target" portion. The lower cleaning film 58 may be disposed so as to be opposite to an entire portion of the photosensitive drum 51 to be contacted at the sheet target portion.

The fixing unit 70 in this example printer structure 1 is disposed downstream from the process unit 40 in the sheet conveying direction. This example fixing unit 70 includes the fixing roller 71, the pressure roller 72 and a thermostat 73. The fixing roller 71 may be formed to include a gear. The pressure roller 72 presses against the fixing roller 71. If desired, the fixing roller 71 and/or the thermostat 73 may be covered with a cover 74, as illustrated in FIG. 1.

The fixing roller 71 may be made of metal and may include a heater (e.g., a halogen lamp) that generates heat. The pressure roller 72 may be rotatable and may include a spring (not shown) that presses or urges the pressure roller 72 from below toward a central axis of the fixing roller 71. In this manner, the pressure roller 72 intimately contacts the fixing roller 71 or the sheet and rotates in synchronization with the fixing roller 71.

The thermostat 73 in this illustrated example is made of a bimetal. The thermostat 73 maintains the temperature of the fixing roller 71 within an appropriate range by turning the power of the heater that heats the fixing roller 71, on and off, depending on the temperature of the fixing roller 71.

The thermostat 73 may be disposed above the fixing roller 71 and may constitute an extension connected between a rotational center of the pressure roller 72 and a rotational center of the fixing roller 71. With this structure, a recessed portion 3*a* of the output tray 3 can be provided at a lower position as compared with cases where the thermostat 73 is disposed at a position vertical to the fixing roller 71 or at a rearward position with respect to the fixing roller 71.

The cover 74 covers the side and upper portions of the fixing roller 71 so that heat generated from the fixing roller 71 does not adversely affect other devices or units (e.g., the scanner unit 100) disposed at the vicinity of the fixing unit 70. The cover 74 supports the pressure roller 72 at the central shaft thereof so that the pressure roller 72 can rotate and move in the urging direction of the spring. A lower half of the pressure roller 72 may be exposed through the cover 74. With this structure, in the laser printer 1, the height of the fixing unit 71 can be reduced by the height of the cover 74 as compared with a case where the entire body of the pressure roller 72 is covered with the cover 74.

In the fixing unit 70, the fixing roller 71 fixes the toner image, which has been transferred onto the sheet in the process unit 40, on the sheet by application of heat and/or pressure, while the sheet passes between the fixing roller 71 and the pressure roller 72. In addition, the fixing roller 71 in this example structure 1 conveys the sheet to a pair of discharge rollers 83 via a sheet discharge path defined by guide members 81, 82, after the image is fixed onto the sheet. Then, the discharge rollers 83 discharge the sheet onto the output tray 3.

The pair of discharge rollers 83 also functions as a discharge port 84 for discharging the sheet to the outside of the laser printer 1.

If the sheet is sharply bent while being heated by the fixing roller 71, the sheet may not return to its original state (a non-bent state) from the bent state. Therefore, the guide members 81, 82 through which the sheet passes are gently curved at the portion immediately next to the fixing roller 71 and then are more sharply curved at the portion near the discharge rollers 83.

With this structure, the discharge port 84 can be provided at a lower position as compared with cases where the entire sheet discharge path is gently curved. In addition, the height of the laser printer 1 can be reduced while the sheet still can be prevented from being permanently bent.

The output tray 3 is gradually inclined downward from the front to the rear of the laser printer 1. The lowest portion (the recessed portion 3*a*) of the output tray 3 is located at a position that is lower than the top of the fixing unit 70. The discharge rollers 83 can be located at a further lower position without reducing the number of sheets that can be loaded in the output tray 3. With this structure, the height of the laser printer 1 near the scanner unit 100 location can be substantially the same as the height of the laser printer 1 near the discharge rollers 83 location. Thus, the laser printer 1 has a good design and appearance.

In the laser printer 1, the substrate on which the controller that controls the rollers and polygon mirror 110 is mounted, is disposed on each side (at a position where the substrate extends along the sides of the process unit 40) of the sheet conveying path.

Next, user attachment and removal of the process unit 40 in this example laser printer structure 1 will be described.

When the process unit 40 is removed from the laser printer 1 in the state shown in FIG. 1, first, the user opens a cover 4 of the laser printer 1 by pulling the cover 4 toward the front. At that time, the cover 4 is rotated about a support shaft or hinge (not shown).

Then, the process unit 40 is substantially horizontally drawn toward the front of the laser printer 1 from the state of FIG. 1 and is removed from the laser printer 1 by passing above the sheet supply roller 14. As described above, a clearance is provided between the process unit 40 and the scanner unit 100, so that the user holds a handle 40*a* provided at a front end of the process unit 40 and lifts the process unit 40 toward the scanner unit 100. Then, the user can pull the process unit 40 out of the laser printer 1. With this structure, the rear portion (on the image forming position X side) of the process unit 40 can be prevented from being caught in the body of the laser printer 1 and the process unit 40 can be smoothly pulled toward the front.

If desired, in accordance with at least some examples of this invention, when the process unit 40 is removed from the laser printer 1, the developing cartridge 60 can be separated from the drum cartridge 50, and the drum cartridge 50 may remain in the laser printer 1. Alternatively, if desired, removal of the process unit 40 may result in removal of both the drum cartridge 50 and the developing cartridge 60 as a unit, and optionally, these cartridges 50 and 60 may be separated from one another once removed from the printer 1.

Figure 4:
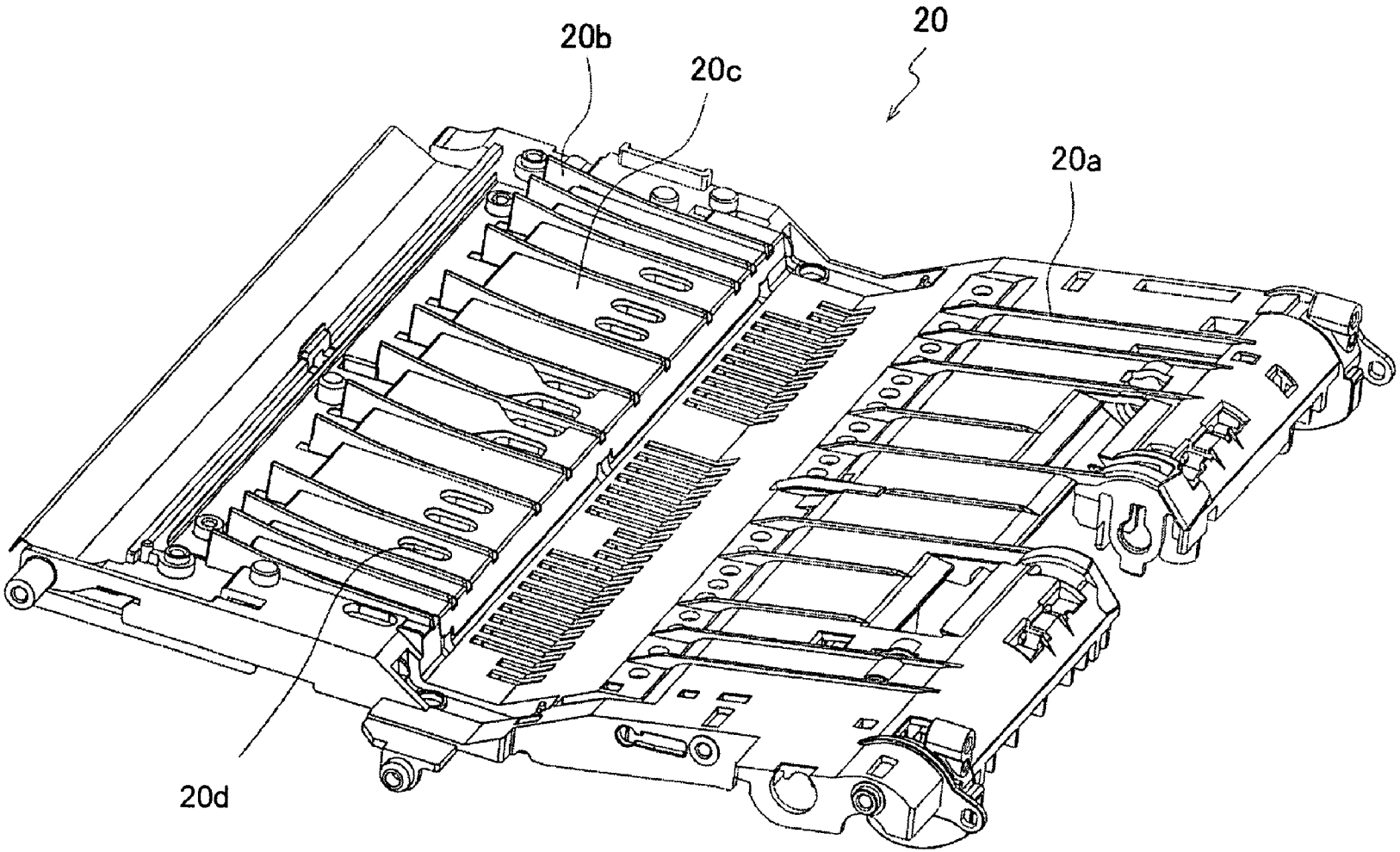
FIG. 4 is a perspective view of an example housing frame according to at least some examples of this invention.

Referring to FIG. 4, an example structure of the housing frame 20 will be described in more detail. The housing frame 20 includes a plurality of guide members 20*a*, 20*b*. The guide members 20*a*, 20*b* protrude from the upper surface of the housing frame 20 to at least partially define the sheet conveying path. Between the guide members 20*b*, ground plates 20*c* are provided in order to obtain a ground potential. The ground plates 20*c* are disposed below the sheet outlet 56 formed in the drum cartridge 50, and these ground plates 20*c* may be provided with one or more communication holes 20*d* in order to allow the inside and outside of the image forming portion 30 (e.g., the process unit 40 and/or drum cartridge 50) of the laser printer 1 to be in communication with one another. Moisture, ozone, and/or other debris accumulating in the drum cartridge 50 and/or the image forming portion 30 may be discharged through communication holes 20*d* so that they do not build up at the sheet outlet opening or elsewhere.

Figure 5:
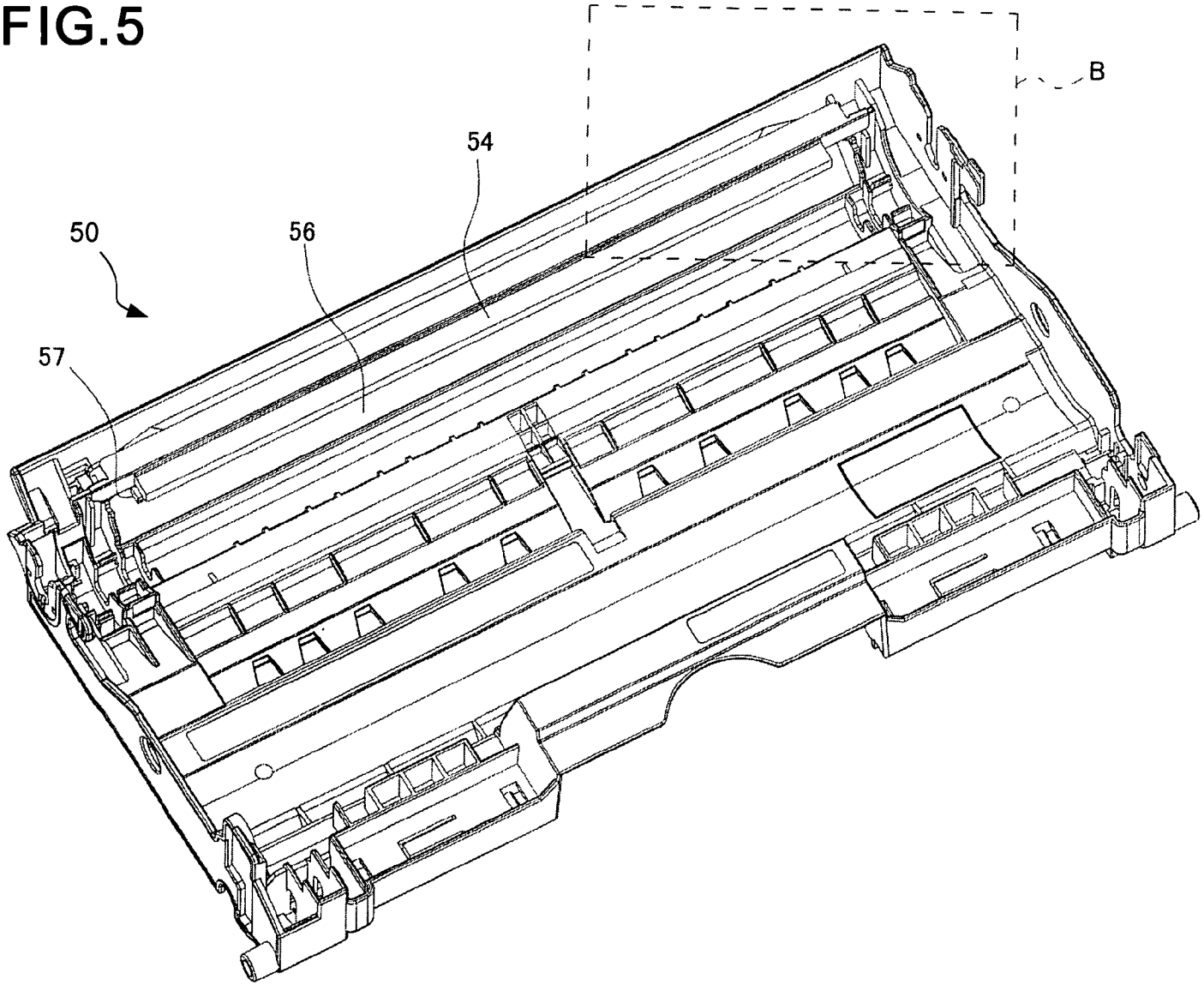
FIG. 5 is a perspective view showing various parts of a drum cartridge structure according to at least some examples of this invention.
Figure 6A:
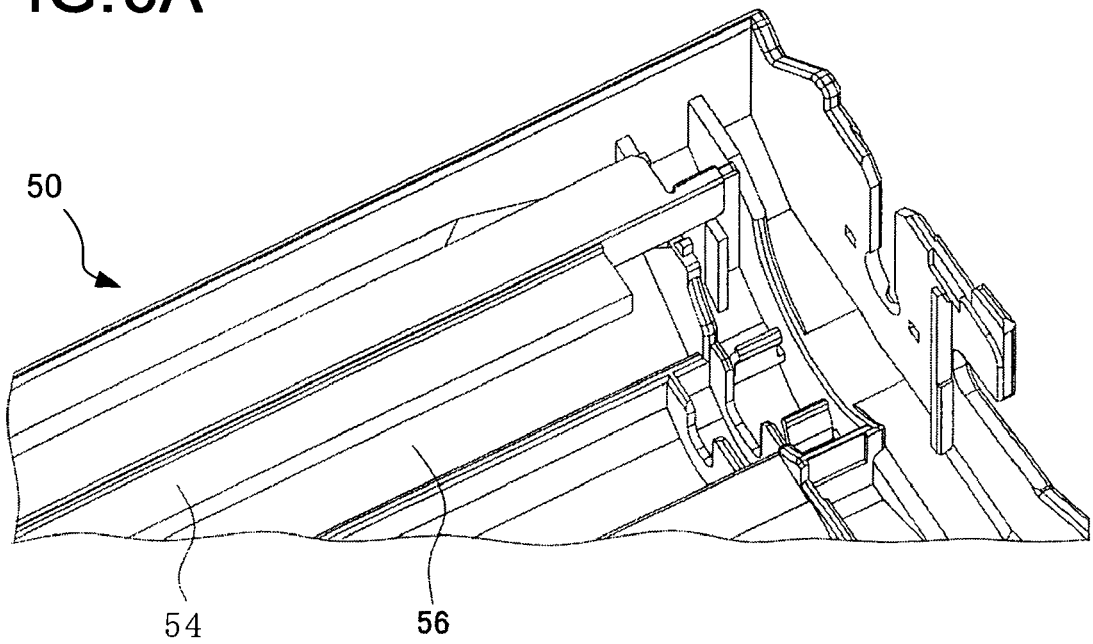
FIG. 6A is an enlarged view of area B enclosed by a dashed line in FIG. 5.
Figure 6B:
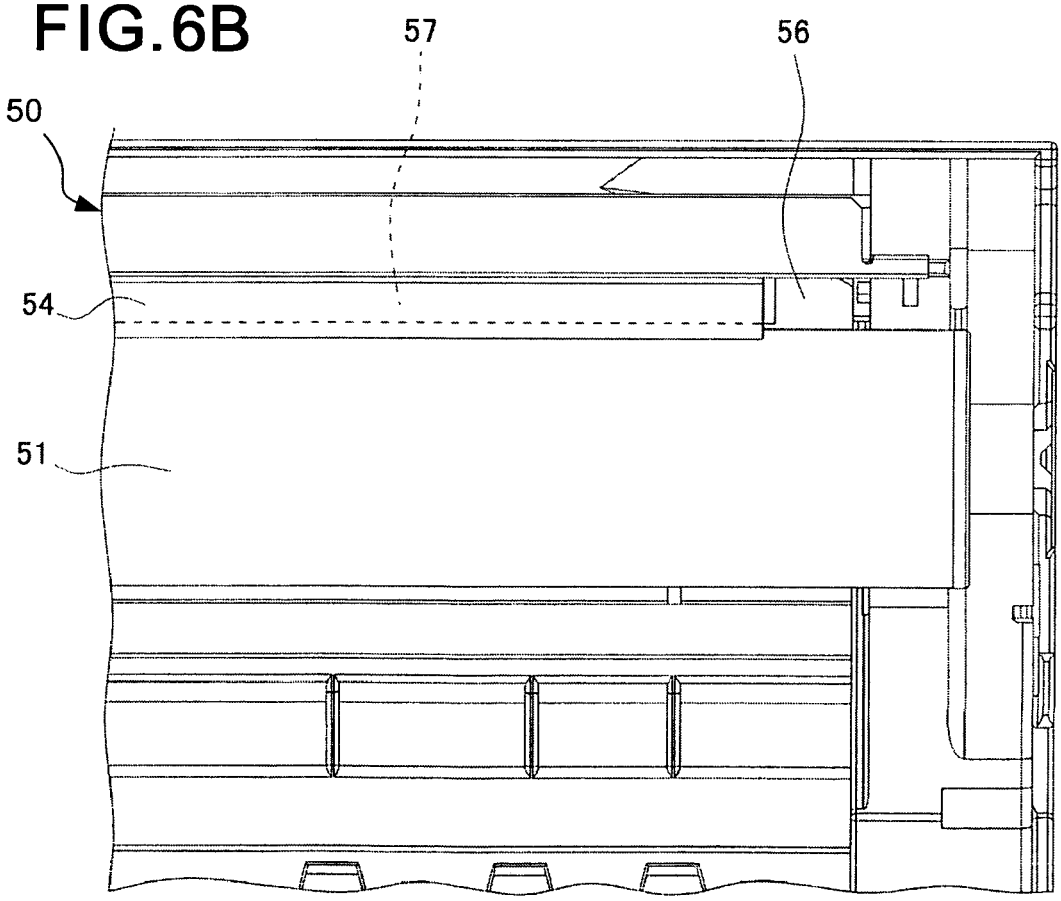
FIG. 6B is a plan view of area B and its surroundings.

Next, FIG. 5 is a perspective view showing various parts of the drum cartridge 50, wherein the photosensitive drum 51, the charging device 52 and the transfer roller 53 are removed therefrom. FIG. 6A is an enlarged view of area B indicated by a dashed line in FIG. 5. FIG. 6B is a plan view of area B and its surroundings. In FIG. 6B, the photosensitive drum 51 is attached to the drum cartridge 50.

Figure 7A:
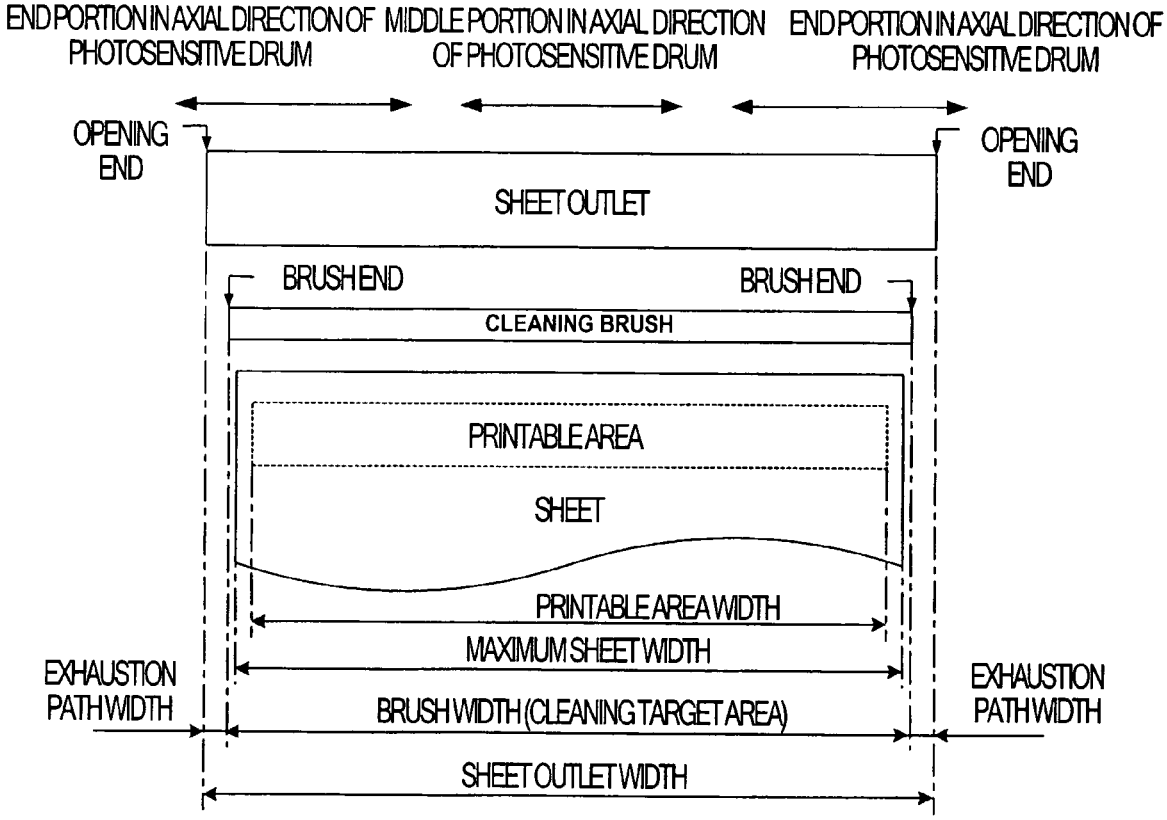
FIG. 7A is an explanatory diagram showing size and positional relationships between a cleaning brush, a sheet outlet, and a sheet to be used in an image forming apparatus according to at least some examples of this invention.

FIG. 7A is an explanatory diagram showing a size relationship and a positional relationship between the cleaning brush 54, the sheet outlet 56 and a sheet to be used in the laser printer 1.

Hereinafter, the direction extending along the rotatable shaft of the photosensitive drum 51 will be referred to as an "axial direction."

As shown in FIGS. 5 to 7A, a width of the cleaning brush 54 (referred to as a "brush width"), which is a dimension thereof in the axial direction, is shorter than a width of the sheet outlet 56 of the drum cartridge 50 (referred to as a "sheet outlet width"), which also is a dimension thereof in the axial direction. A width of the foreign matter receiving portion 57, which also is a dimension thereof in the axial direction, (a receiving portion width) is the same as or slightly wider than the brush width. If desired, the brush 54 may be substantially centered with respect to the sheet outlet in the axial direction, as shown in the figures.

An entire portion of the photosensitive drum 51 that may contact a sheet having a maximum width that can be used in the laser printer 1 (e.g., a photosensitive drum whose dimension in the axial direction is at least equal to a maximum sheet width), corresponds to a cleaning target area (whose dimension in the axial direction is at least equal to the brush width). Therefore, the cleaning brush 54 may be sized and positioned so as to enable complete cleaning of the photosensitive drum 51 or at least the cleaning target area. The foreign matter receiving portion 57 may be disposed so that its entire body extends along the cleaning target area of the cleaning brush 54.

That is, the ends of the cleaning brush 54 in the axial direction of the photosensitive drum 51 (referred to as "brush ends") may be located at positions closer to the center or middle portion of the photosensitive drum 51 as compared with the ends of the opening of the sheet outlet 56 (referred to as "opening ends"), i.e., the brush ends may be located within the opening ends of the sheet outlet 56 with respect to the axial direction.

In the housing of the drum cartridge 50, the space between the housing of the drum cartridge 50 and the photosensitive drum 51 is divided into an upper portion and a lower portion by the cleaning brush 54. An air exhaustion path is provided in the housing of the drum cartridge 50 in the vicinity of each end portion of the photosensitive drum 51 in the axial direction (see the portion that is in communication with the sheet outlet 56 in FIG. 6B). The air exhaustion paths allow the divided upper and lower portions of the housing to be in fluid communication with each other and extend to the sheet outlet 56 to allow air (plus ozone, moisture, debris, etc.) to pass therethrough.

Utilizing the example laser printer structure 1 as described above, moisture, ozone, and/or other debris which may cause banding (a band of white stripe) or print dropout in a printed result can be prevented from building up above the cleaning brush 54 in the housing of the drum cartridge 50.

In addition, in this example laser printer 1, the moisture, ozone, and/or other debris discharged from the sheet outlet 56 are further discharged outside of the image forming portion 30, the process unit 40, and/or the drum cartridge 50 of the laser printer 1 via the communication holes 20*d* formed in the ground plates 20*c*. With this example structure, the moisture, ozone, and/or other debris are also prevented from building up at the vicinity of the sheet outlet 56, so that these undesired elements can be efficiently and effectively removed from the vicinity of the photosensitive drum 51.

More specifically, as an example, because ozone is heavier than air, ozone can be efficiently discharged outside of the image forming portion 30 (e.g., outside the process unit 40 and/or drum cartridge 50) of the laser printer 1 through the air exhaustion paths extending to the sheet outlet 56 and the communication holes 20*d* provided under the sheet outlet 56. Further, moisture also is efficiently discharged to the outside by the flow of air caused in accordance with the discharge of the ozone.

Generally, as described above, paper dust is likely to come out from end portions of a sheet in a width direction thereof. Therefore, the portions of the photosensitive drum 51 where the end portions of the sheet make contact tend to catch paper dust. Thus, the size and mounting position of the cleaning brush 54 may be determined such that the portions of the photosensitive drum 51 with which the end portions of the sheet make contact, correspond to the cleaning target area. Accordingly, paper dust adhered to the photosensitive drum 51 from the sheet can be effectively removed from the photosensitive drum 51 by the cleaning brush 54.

In this example laser printer structure 1, the charging device 52 is disposed in an inclined manner toward the cleaning brush 54 with respect to the photosensitive drum 51 and not vertical to the photosensitive drum 51. In addition, as described above in conjunction with FIG. 3, the pair of guide walls 59 is arranged such that the clearance distance d2 provided between the tip of the first (upstream) guide wall portion 59*a* and the surface of the photosensitive drum 51 is larger than the clearance distance d1 provided between the tip of the second (downstream) guide wall portion 59*b* and the surface of the photosensitive drum 51 (the "upstream" and "downstream" directions are relative to the drum 51 rotation direction). With this structure, ozone generated by use of the charging device 52 can be effectively led to the air exhaustion paths.

In some of the example printer structures 1 described above, the size (brush width) and mounting position of the cleaning brush 54 are determined based on the maximum sheet width and/or maximum printable area width for the printer 1. However, in some instances, it may be difficult to determine the size and mounting position based on the maximum sheet width. Therefore, if desired, in accordance with at least some examples of this invention, the cleaning brush size and/or positioning may be determined based on a width of a minimum size sheet that can be used in the laser printer 1 so that at least paper dust (or other debris) adhering to the photosensitive drum 51 from a minimum sized sheet area may be collected and removed from the drum 51 by the cleaning brush 54.

Figure 7B:
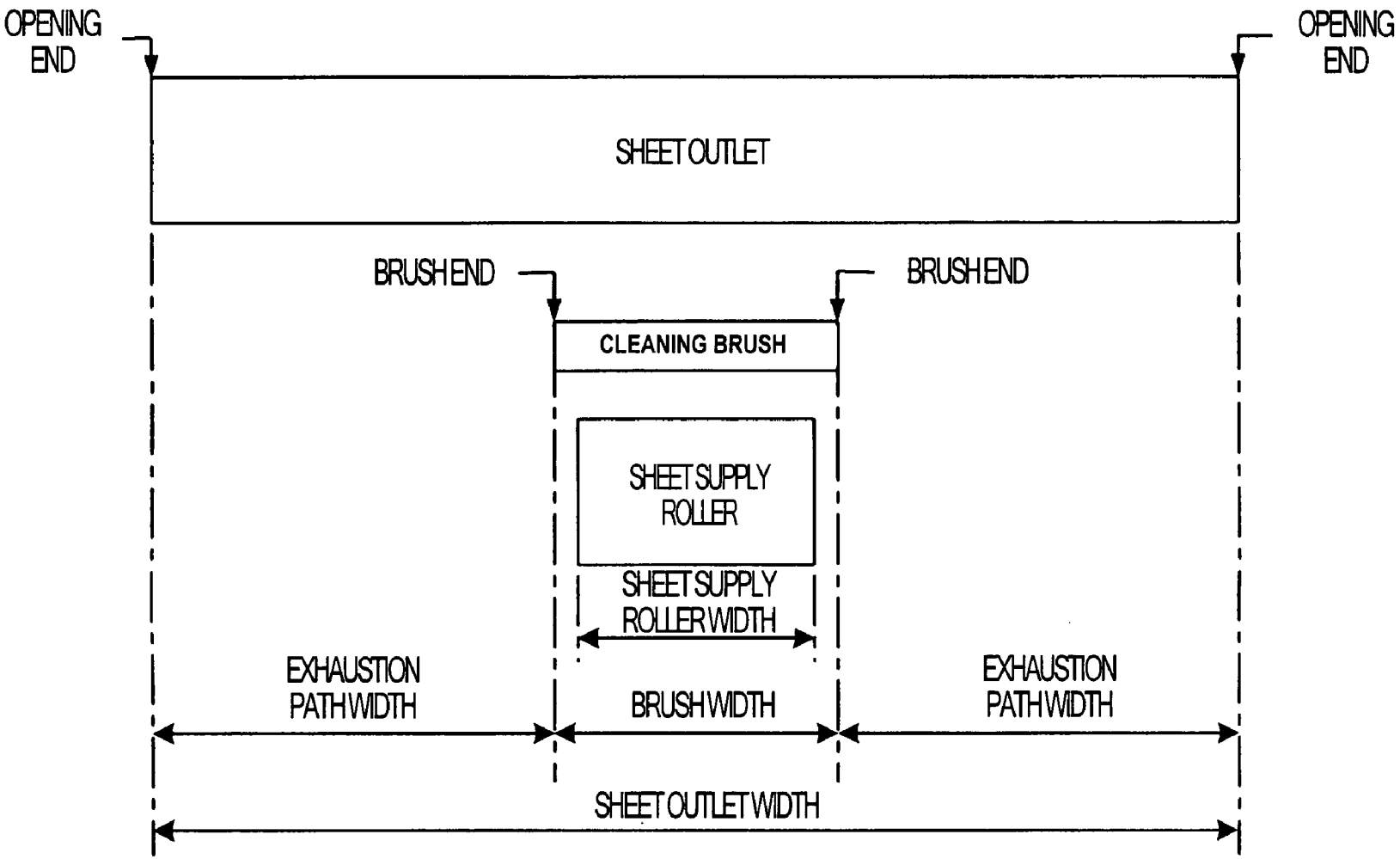
FIG. 7B is an explanatory diagram showing size and positional relationships between a cleaning brush, a sheet outlet, and a sheet to be used in an image forming apparatus according to at least some additional examples of the invention.
Figure 8:
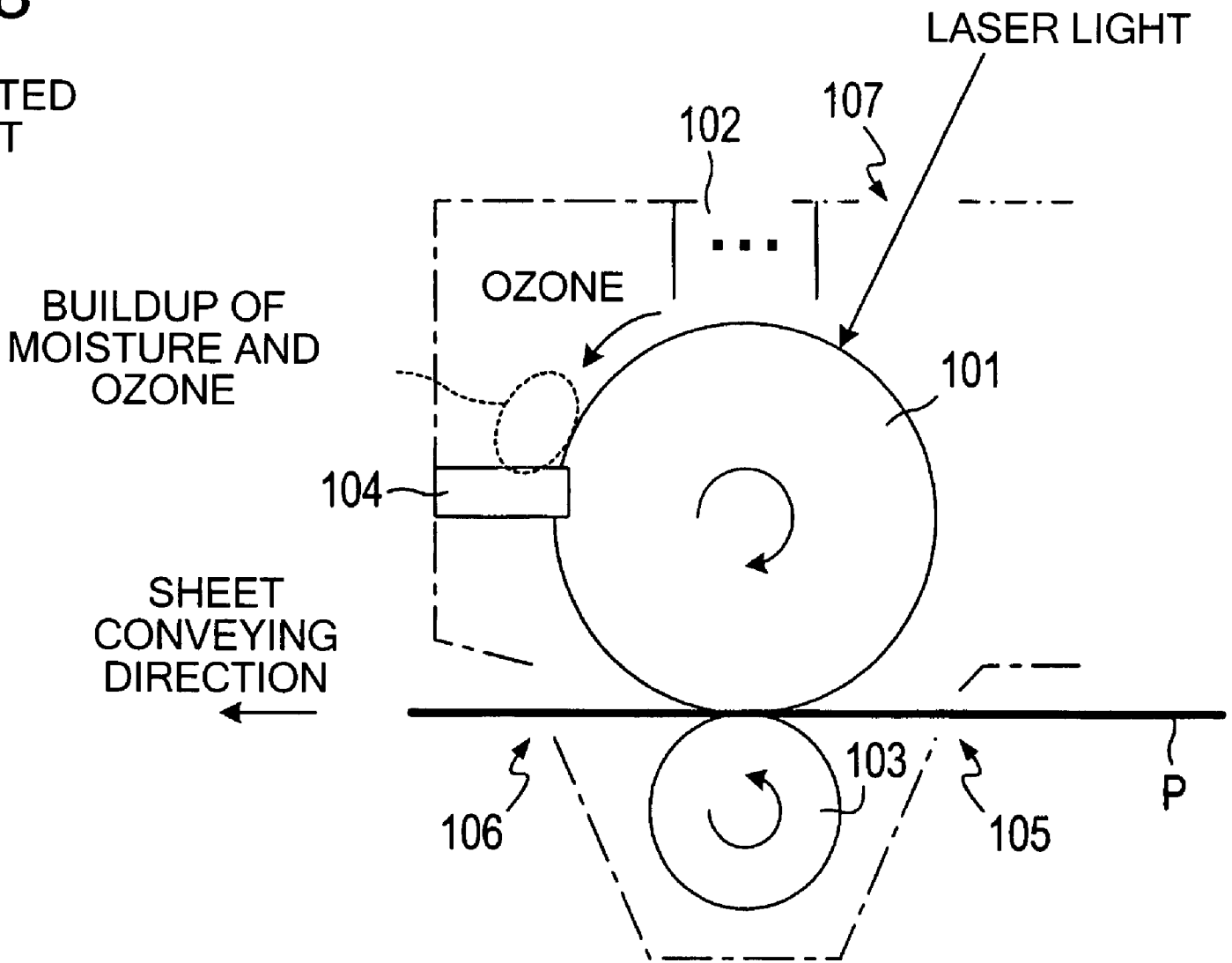
FIG.8 RELATED ART
FIG. 8 is an explanatory diagram showing a structure of a conventional drum cartridge.

As still another alternative, as shown in FIG. 7B, in accordance with at least some examples of this invention, a portion of a sheet to be contacted with the sheet supply roller 14 (or other rollers) may be referred to as a "sheet target portion." Based on the width and/or location(s) of the sheet supply roller 14 (or other rollers) (referred to as a "roller width"), which is a dimension thereof in the axial direction, the size and/or mounting position(s) of the cleaning brush 54 (e.g., one or more brushes) can be determined such that an entire portion of the photosensitive drum 51 that contacts the sheet target portion corresponds to a cleaning target area where the cleaning brush 54 cleans the photosensitive drum 51. In this case, only the portions of the photosensitive drum 51 to which paper dust or other debris is more likely to adhere, corresponding to the cleaning target area of the cleaning brush 54, are contacted by the cleaning brush 54 so that the cleaning brush 54 can be designed with a minimum or relatively small brush width. Therefore, the width of the air exhaustion paths can be widened, and moisture and ozone (and other debris) can be further effectively discharged from the housing of the drum cartridge 50.

III. Conclusion

While the invention has been described using a laser printer as a specific example, those skilled in the art will recognize that aspects of the invention can be utilized in a variety of arrangements and systems, including, for example, in copiers, facsimile machines, multi-functional machines, etc. Also, while the invention has been described in detail with reference to the specific example structures, those skilled in the art will recognize that various changes, arrangements, and modifications may be used and applied to the disclosed structures without departing from the invention. For example, systems in accordance with the invention may include elements or features in addition to those described above and/or various elements and features from the specific example structures described above may be omitted without departing from the invention. Other variations in the structures also are possible. For example, the cleaning member may take on various different forms, including multiple independent brush structures, mounted at various locations along the axial length of the photosensitive member, without departing from this invention. As another example variation, the photosensitive member may constitute a belt or other structure, as opposed to the drum structures described above, without departing from this invention. Such variations, and others, fall within the spirit and scope of the invention, as defined by the following claims.

What is claimed is:

1. An image carrying member cartridge, comprising:

an image carrying member;

a charging device disposed along an axial direction of the image carrying member for charging the image carrying member;

a cleaning member disposed below the charging device and along the axial direction of the image carrying member, wherein the cleaning member is arranged to remove adherents from the image carrying member;

a transfer roller disposed facing the image carrying member; and a cartridge housing, wherein the image carrying member, the charging device, the transfer roller, and the cleaning member are accommodated within the cartridge housing, wherein the cartridge housing includes a sheet outlet below the cleaning member to discharge therefrom a recording medium, wherein ends of the cleaning member in the axial direction of the image carrying member are located closer to a center of the image carrying member in the axial direction thereof as compared with ends of an opening of the sheet outlet in the axial direction of the image carrying member so as to not completely obstruct a space extending from the charging device to the sheet outlet along a surface of the image carrying member.

2. The image carrying member cartridge according to claim 1, wherein the recording medium is a paper sheet, and wherein the adherents to be removed by the cleaning member include at least paper dust.

3. The image carrying member cartridge according to claim 1, wherein the adherents to be removed by the cleaning member include at least a developing agent applied to the image carrying member.

4. The image carrying member cartridge according to claim 1, wherein the cleaning member is sized and positioned so as to span a maximum recording medium dimension in the axial direction.

5. The image carrying member cartridge according to claim 1, wherein the cleaning member is sized and positioned so as to span a maximum printable area dimension of the recording medium in the axial direction.

6. The image carrying member cartridge according to claim 1, wherein the cleaning member is sized and positioned so as to at least span a minimum recording medium dimension in the axial direction.

7. The image carrying member cartridge according to claim 1, further comprising a receiving member disposed below the cleaning member to receive the adherents removed by the cleaning member.

8. The image carrying member cartridge according to claim 7, wherein the ends of the receiving member in the axial direction are located at positions substantially the same as positions where the ends of the cleaning member are located.

9. The image carrying member cartridge according to claim 7, wherein the ends of the receiving member in the axial direction are located at positions closer to end portions of the image carrying member in the axial direction thereof than where the ends of the cleaning member are located.

10. The image carrying member cartridge according to claim 1, wherein the cartridge housing includes a first guide wall that extends in the axial direction along a surface of the image carrying member and is separated therefrom by a first clearance distance, wherein the first guide wall is located along an upstream side of the charging device with respect to a rotating direction of the image carrying member, wherein the cartridge housing further includes a second guide wall that extends in the axial direction along the surface of the image carrying member and is separated therefrom by a second clearance distance, wherein the second guide wall is located along a downstream side of the charging device with respect to the rotating direction of the image carrying member, and wherein the first clearance distance is larger than the second clearance distance.

11. The image carrying member cartridge according to claim 1, wherein the cleaning member is substantially centered in the axial direction with respect to the sheet outlet.

12. An image carrying member cartridge, comprising:

an image carrying member;

a charging device disposed along an axial direction of the image carrying member for charging the image carrying member;

a cleaning member disposed below the charging device and along the axial direction of the image carrying member, wherein the cleaning member is arranged to remove adherents from the image carrying member;

a transfer roller disposed facing the image carrying member; and a cartridge housing, wherein the image carrying member, the charging device, the transfer roller, and the cleaning member are accommodated within the cartridge housing, wherein the cartridge housing includes a sheet outlet below the cleaning member to discharge therefrom a recording medium, wherein a dimension of the cleaning member in the axial direction of the image carrying member is less than a dimension of an opening of the sheet outlet in the axial direction of the image carrying member so as to not completely obstruct a space extending from the charging device to the sheet outlet along a surface of the image carrying member.

13. The image carrying member cartridge according to claim 12, wherein the recording medium is a paper sheet, and wherein the adherents to be removed by the cleaning member include at least paper dust.

14. The image carrying member cartridge according to claim 12, wherein the adherents to be removed by the cleaning member include at least a developing agent applied to the image carrying member.

15. The image carrying member cartridge according to claim 12, wherein the cleaning member is sized and positioned so as to span a maximum recording medium dimension in the axial direction.

16. The image carrying member cartridge according to claim 12, wherein the cleaning member is sized and positioned so as to span a maximum printable area dimension of the recording medium in the axial direction.

17. The image carrying member cartridge according to claim 12, further comprising a receiving member disposed below the cleaning member to receive the adherents removed by the cleaning member.

18. The image carrying member cartridge according to claim 17, wherein the ends of the receiving member in the axial direction are located at positions substantially the same as positions where the ends of the cleaning member are located.

19. The image carrying member cartridge according to claim 17, wherein the ends of the receiving member in the axial direction are located at positions closer to end portions of the image carrying member in the axial direction thereof than where the ends of the cleaning member are located.

20. The image carrying member cartridge according to claim 12, wherein the cartridge housing includes a first guide wall that extends in the axial direction along a surface of the image carrying member and is separated therefrom by a first clearance distance, wherein the first guide wall is located along an upstream side of the charging device with respect to a rotating direction of the image carrying member, wherein the cartridge housing further includes a second guide wall that extends in the axial direction along the surface of the image carrying member and is separated therefrom by a second clearance distance, wherein the second guide wall is located along a downstream side of the charging device with respect to the rotating direction of the image carrying member, and wherein the first clearance distance is larger than the second clearance distance.

21. An image forming apparatus, comprising:

an image carrying member;

a charging device disposed along an axial direction of the image carrying member for charging the image carrying member;

a cleaning member disposed below the charging device and along the axial direction of the image carrying member, wherein the cleaning member is arranged to remove adherents from the image carrying member;

a transfer roller disposed facing the image carrying member; and a support member, wherein the image carrying member, the charging device, the transfer roller and the cleaning member, are accommodated by the support member, wherein the support member includes a sheet outlet below the cleaning member to discharge therefrom a recording, medium, wherein ends of the cleaning member in the axial direction of the image carrying member are located closer to a center of the image carrying member in the axial direction thereof as compared with ends of an opening of the sheet outlet in the axial direction of the image carrying member so as to not completely obstruct a space extending from the charging device to the sheet outlet along a surface of the image carrying member.

22. The image forming apparatus according to claim 21, further comprising a housing disposed below the sheet outlet, wherein the housing includes an opening defined therein, wherein the opening allows an interior of an image forming portion of the image forming apparatus to communicate with an exterior of the image forming portion.

23. The image forming apparatus according to claim 21, further comprising a conveyor roller provided in a recording medium conveying path that extends from a recording medium accommodating portion to the image carrying member, wherein a portion of the recording medium that contacts the conveyor roller corresponds to a target portion, and wherein the cleaning member is sized and positioned so as to clean at least an entire portion of the image carrying member where the target portion contacts during transfer of a visible image.

24. An image forming apparatus, comprising:

an image carrying member;

a charging device disposed along an axial direction of the image carrying member for charging the image carrying member;

a cleaning member disposed below the charging device and along the axial direction of the image carrying member, wherein the cleaning member is arranged to remove adherents from the image carrying member;

a transfer roller disposed facing the image carrying member; and a support member, wherein the image carrying member, the charging device, the transfer roller, and the cleaning member are accommodated by the support member, wherein the support member includes a sheet outlet below the cleaning member to discharge therefrom a recording medium, wherein a dimension of the cleaning member in the axial direction of the image carrying member is less than a dimension of an opening of the sheet outlet in the axial direction of the image carrying member so as to not completely obstruct a space extending from the charging device to the sheet outlet along a surface of the image carrying member.

25. The image forming apparatus according to claim 24, further comprising a housing disposed below the sheet outlet, wherein the housing includes an opening defined therein, wherein the opening allows an interior of an image forming portion of the image forming apparatus to communicate with an exterior of the image forming portion.

26. The image forming apparatus according to claim 24, further comprising a conveyor roller provided in a recording medium conveying path that extends from a recording medium accommodating portion to the image carrying member, wherein a portion of the recording medium that contacts the conveyor roller corresponds to a target portion, and wherein the cleaning member is sized and positioned so as to clean at least an entire portion of the image carrying member where the target portion contacts during transfer of a visible image.

* * * * *